US010453389B2

(12) United States Patent
Dai et al.

(10) Patent No.: US 10,453,389 B2
(45) Date of Patent: Oct. 22, 2019

(54) PIXEL CIRCUIT, ORGANIC ELECTROLUMINESCENT DISPLAY PANEL AND DISPLAY APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Lei Dai, Beijing (CN); Young Yik Ko, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 0 days.

(21) Appl. No.: 15/147,267

(22) Filed: May 5, 2016

(65) Prior Publication Data

US 2017/0069264 A1 Mar. 9, 2017

(30) Foreign Application Priority Data

Sep. 9, 2015 (CN) ..... 2015 1 0571804

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/08* (2013.01); *G09G 2320/0233* (2013.01); *G09G 2320/0247* (2013.01); *G09G 2320/045* (2013.01); *G09G 2330/026* (2013.01)

(58) Field of Classification Search
CPC ..... G09G 3/3233; G09G 2330/026
See application file for complete search history.

(56) References Cited

U.S. PATENT DOCUMENTS 8,411,016 B2 * 4/2013 Tanikame ..... G09G 3/3266 345/100
8,466,855 B2 * 6/2013 Han ..... H05B 33/0896 315/169.1
2007/0024541 A1 * 2/2007 Ryu ..... G09G 3/3233 345/76

(Continued)

FOREIGN PATENT DOCUMENTS

CN 104252835 A 12/2014
CN 104361862 A 2/2015

(Continued)

OTHER PUBLICATIONS

First Chinese Office Action dated Mar. 22, 2017; Appln. No. 201510571804.1.

*Primary Examiner* — Nitin Patel
*Assistant Examiner* — Robert M Stone

(57) ABSTRACT

The present disclosure discloses a pixel circuit, an organic electroluminescent display panel and a display apparatus. By adding one switch module in the pixel circuit, the abnormal drive current output by the driving module may be prevented from flowing to the light emitting device during a first frame of display picture as startup, and thus the problem of screen flicker can be overcome in the screen of the first frame when the display panel is started up.

20 Claims, 7 Drawing Sheets

(56) References Cited

U.S. PATENT DOCUMENTS

| | | | | |
|---|---|---|---|---|
| 2007/0126665 | A1* | 6/2007 | Kimura | G09G 3/3233 345/76 |
| 2009/0146987 | A1* | 6/2009 | Kim | G09G 3/3233 345/212 |
| 2012/0235972 | A1* | 9/2012 | Liu | G09G 3/3233 345/211 |
| 2012/0293479 | A1* | 11/2012 | Han | G09G 3/003 345/212 |
| 2013/0050067 | A1* | 2/2013 | Yamashita | G09G 3/3233 345/76 |
| 2013/0321249 | A1* | 12/2013 | Kimura | G09G 3/3233 345/76 |
| 2014/0320545 | A1* | 10/2014 | Jeon | G09G 3/3233 345/690 |
| 2014/0354522 | A1* | 12/2014 | Chung | G09G 3/003 345/82 |
| 2015/0002560 | A1 | 1/2015 | Kwon et al. | |
| 2015/0062193 | A1* | 3/2015 | Kanda | G09G 3/3233 345/690 |
| 2016/0098955 | A1 | 4/2016 | Huang et al. | |
| 2016/0163259 | A1* | 6/2016 | Kanda | G09G 3/3233 345/690 |
| 2016/0335937 | A1 | 11/2016 | Lee et al. | |
| 2016/0358546 | A1 | 12/2016 | Ma | |

FOREIGN PATENT DOCUMENTS

| | | | |
|---|---|---|---|
| CN | 104464636 | A | 3/2015 |
| CN | 104680976 | A | 6/2015 |
| KR | 1020150061898 | A | 6/2015 |

* cited by examiner

PIXEL CIRCUIT, ORGANIC ELECTROLUMINESCENT DISPLAY PANEL AND DISPLAY APPARATUS

TECHNICAL FIELD

Embodiments of the present disclosure relate to a pixel circuit, and organic electroluminescent display panel and a display apparatus.

BACKGROUND

With advancements of the display technology, an Organic Light Emitting Diode (OLED) is one hot spot of a research field for current panel displays; more and more Active Matrix Organic Light Emitting Diode (AMOLED) display panels have come into the market, and as compared with a traditional Thin Film Transistor Liquid Crystal Displays (TFT LCDs), the AMOLEDs are of a faster response speed, a higher contrast as well as a wider viewing angle. The AMOLED is an autonomous light emitting device, and may realize a broad viewing angle display and may realize a panel display such as an ultra-thin display, a flexible display, etc., without an assistance of a backlight; the AMOLED is capable of emitting light because it is driven by a current generated by a drive transistor in a pixel circuit when the drive transistor is in a saturation state.

Generally, as shown in FIG. 1, an existing pixel circuit consists mainly of seven transistors of M1-M7 and one capacitor C, wherein the transistor M3 is a drive transistor; when the AMOLED display panel is started up to display a first frame, prior to the pixel circuit being charged, a power supply signal VDD loaded onto the pixel circuit is generally a ground level signal, i.e., 0V, then a gate voltage of the drive transistor M3 in the pixel circuit is 0V−Vth (Vth is a threshold voltage of the drive transistor); and during a light emitting stage, the power supply signal loaded onto the pixel circuit becomes a high voltage (for example 4.5V), and a voltage difference Vgd between a gate and a drain of the drive transistor M3 (the voltage difference between the Gate-Drain, which determines turning-on or turning off the TFT) becomes larger, and a voltage signal for driving the OLED to emit light becomes abnormal, therefore a drive current for driving the OLED to emit light which is output by the drive transistor M3 also becomes an abnormally large current; then even if a normal drive current is output by the pixel circuit for a next frame, a problem of screen flicker may occur in the first frame in the startup screen due to the aforementioned abnormal drive occurring in the screen of the first frame.

In addition, before a low level signal is loaded onto the pixel circuit, since an output terminal for outputting a low level signal in a power supply signal chip is in a floating state, and an output terminal for outputting a high level signal to the pixel circuit in power supply signal chip is on, and since after the transistors M3 and M6 are both turned on, the low level signal terminal VSS is at a positive potential; and when the low level signal output terminal of the power supply signal chip is on, since the low level signal terminal VSS of the pixel circuit is at the positive potential, there are difficulties for the low level signal terminal VSS of this pixel circuit to receive a signal, thus the power supply signal chip for providing the power supply signal may be damaged or broken; in this case, a self-protection device of the power source chip may perform a protection function and cut off the power source, which may cause the abnormal displaying of the display panel screen.

Accordingly, the technical problems needed to be solved by those skilled in the art are as follows: how to overcome the problem of screen flicker due to the abnormal drive current output by the pixel circuit when the display panel is started up and the first frame is displayed on a screen; and how to overcome the problem of the abnormal displaying of the display panel due to the self-protection function of a power supply signal chip triggered by the difficulty for the low level signal terminal of the pixel circuit receiving a positive potential and a negative potential.

SUMMARY

Embodiments of the present disclosure provide a pixel circuit, an organic electroluminescent display panel and a display apparatus, which can solve the following problems in the prior art: the screen flicker due to the abnormal drive current output by the pixel circuit when the display panel is started up and the first frame is displayed a screen; and the abnormal displaying of the display panel due to the self-protection function of a power supply signal chip triggered by the difficulty for the low level signal terminal of the pixel circuit receiving a positive potential and a negative potential.

An embodiment of the present disclosure provides a pixel circuit comprising: a light emitting device, a driving module configured to drive the light emitting device to emit light and a control module configured to control the light emitting device to emit light during a light emitting stage; the pixel circuit further comprises a switch module;

a control terminal of the switch module is connected with a switch signal terminal, an input terminal of the switch module is connected with an output terminal of the driving module, and an output terminal of the switch module is connected with an input terminal of the control module;

a control terminal of the control module is connected with a light emitting signal terminal, and an output terminal of the control module is connected with an input terminal of the light emitting device; and an output terminal of the light emitting device is connected with a low level signal terminal;

under the control of the switch signal terminal, the switch module is configured to be in an off state during a first frame of display picture as startup so as to prevent an abnormal drive current output by the driving module from flowing to the control module, and is configured to be in an on state from a second frame of display picture so as to output a normal drive current output by the driving module to the control module;

under the control of the light emitting signal terminal, the control module outputs the normal drive current output by the driving module to the input terminal of the light emitting device during the light emitting stage, and the light emitting device emits light normally when driven by the normal drive current.

In one possible implementation, in the above-mentioned pixel circuit according to the embodiment of the present disclosure, the switch module comprises: a first switch transistor;

a gate of the first switch transistor is connected with the switch signal terminal, a source of the first switch transistor is connected with the output terminal of the driving module, and a drain of the first switch transistor is connected with the input terminal of the control module.

In one possible implementation, in the above-mentioned pixel circuit according to the embodiment of the present disclosure, the control module comprises: a second switch transistor;

a gate of the second switch transistor is connected with the light emitting signal terminal, a source of the second switch transistor is connected with an output terminal of the switch module, and a drain of the second switch transistor is connected with the input terminal of the light emitting device.

In one possible implementation, in the above-mentioned pixel circuit according to the embodiment of the present disclosure, the driving module comprises: an initialization unit, a charging unit, a compensation unit and a driving unit;

a control terminal of the driving unit is connected with a first node, an input terminal of the driving unit is connected with a high level signal terminal, and an output terminal of the driving unit is connected with an input terminal of the switch module and an input terminal of the compensation unit respectively; a control terminal of the compensation unit is connected with a scanning signal terminal, an output terminal of the compensation unit is connected with the first node; a first control terminal of the charging unit is connected with the scanning signal terminal, a second control terminal of the charging unit is connected with of the light emitting signal terminal, a first input terminal of the charging unit is connected with a data signal terminal, a second input terminal of the charging unit is connected with a reference signal terminal, and an output terminal of the charging unit is connected with a second node; the initialization unit is connected with a reset signal terminal, a restore signal terminal, the high level signal terminal and the first node;

during an initialization stage, under the control of the reset signal terminal, the initialization unit is configured to perform initialization on the first node and the second node by a signal input via the restore signal terminal and a signal input via the high level signal terminal respectively; during a charging stage, under the control of the scanning signal terminal, the compensation unit is configured to perform a compensation for the threshold voltage of the driving unit at the first node, and under the control of the scanning signal terminal, the charging unit is configured to perform a data writing at the first node by a signal input via the data signal terminal; during the light emitting stage, under the control of the light emitting signal terminal, the charging unit is configured to perform an adjustment on a voltage signal at the first node by a signal input via the reference signal terminal, and under the control of the first node at which the voltage signal is adjusted, the driving unit outputs to the input terminal of the switch module a drive current for driving the light emitting device to emit light.

In one possible implementation, in the above-mentioned pixel circuit according to the embodiment of the present disclosure, the driving unit comprises: a drive transistor;

a gate of the drive transistor is connected with the first node, a source of the drive transistor is connected with the high level signal terminal, and a drain of the drive transistor is connected with an input terminal of the switch module.

In one possible implementation, in the above-mentioned pixel circuit according to the embodiment of the present disclosure, the compensation unit comprises: a third switch transistor;

a gate of the third switch transistor is connected with the scanning signal terminal, a source of the third switch transistor is connected with the output terminal of the driving unit, and a drain of the third switch transistor is connected with the first node.

In one possible implementation, in the above-mentioned pixel circuit according to the embodiment of the present disclosure, the charging unit comprises: a fourth switch transistor and a fifth switch transistor; wherein, a gate of the fourth switch transistor is connected with the scanning signal terminal, a source of the fourth switch transistor is connected with the data signal terminal, and a drain of the fourth switch transistor is connected with the second node;

a gate of the fifth switch transistor is connected with the light emitting signal terminal, the source of the fifth switch transistor is connected with the reference signal terminal, and the drain of the fifth switch transistor is connected with the second node.

In one possible implementation, in the above-mentioned pixel circuit according to the embodiment of the present disclosure, the initialization unit comprises: a sixth switch transistor, a seventh switch transistor and a capacitor; wherein, a gate of the sixth switch transistor is connected with the reset signal terminal, a source of the sixth switch transistor is connected with the restore signal terminal, and a drain of the sixth switch transistor is connected with the first node;

a gate of the seventh switch transistor is connected with the reset signal terminal, a source of the seventh switch transistor is connected with the high level signal terminal, and a drain of the seventh switch transistor is connected with the second node;

the capacitor is connected between the first node and the second node.

An embodiment of the present disclosure provides an organic electroluminescent display panel, which comprises the above-mentioned pixel circuit according to the embodiment of the present disclosure.

An embodiment of the present disclosure provides a display apparatus, which comprises the above-mentioned organic electroluminescent display panel according to the embodiment of the present disclosure.

The advantageous effects according to embodiments of the present disclosure are as follows.

Embodiments of the present disclosure provide a pixel circuit, an organic electroluminescent display panel and a display apparatus, the pixel circuit comprises: a light emitting device, a driving module configured to drive the light emitting device to emit light, and a control module configured to control the light emitting device to emit light during a light emitting stage; and the pixel circuit further comprises: a switch module; under the control of the switch signal terminal, the switch module is configured to be in an off state during a first frame of display picture as startup so as to prevent the abnormal drive current output by the driving module from flowing to the control module, and is configured to be in an on state from a second frame of display picture so as to output the normal drive current output by the driving module to the control module; under the control of the light emitting signal terminal, the control module outputs the normal drive current output by the driving module to the input terminal of the light emitting device during the light emitting stage, and the light emitting device emits light normally when driven by the normal drive current.

In this way, by adding one switch module in the pixel circuit, the abnormal drive current output by the driving module is prevented from flowing to the light emitting device during the first frame of display picture as startup, and thus the problem of screen flicker can be overcome in the screen of the first frame when the display panel is started up; and additionally since the switch module can prevent the abnormal drive current of the pixel circuit from flowing to the light emitting device, a high level signal can be prevented from flowing to the low level signal terminal before a low level signal is input to the low level signal terminal; in this way, a positive potential will not occur before the low level signal terminal of the pixel circuit receives a low level signal, and thus the problem of the abnormal displaying of the display panel due to the self-protection function of a power supply signal chip triggered by the difficulty for the low level signal terminal of the pixel circuit receiving a positive potential and a negative potential can be overcome.

DETAILED DESCRIPTION

Hereinafter, the detailed description of a pixel circuit, an organic electroluminescent display panel and a display apparatus according to embodiments of the present disclosure will be explained in detail with reference to the drawings.

Figure 1:
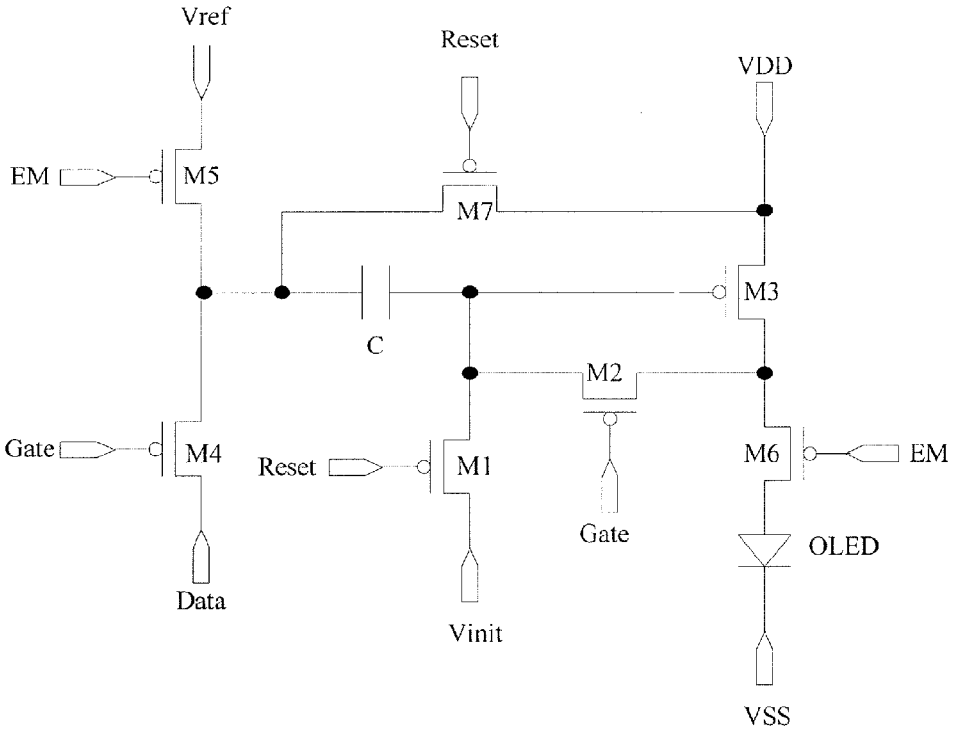
FIG. 1 is an exemplary view illustrating a structure of a pixel circuit in the prior art.
Figure 2:
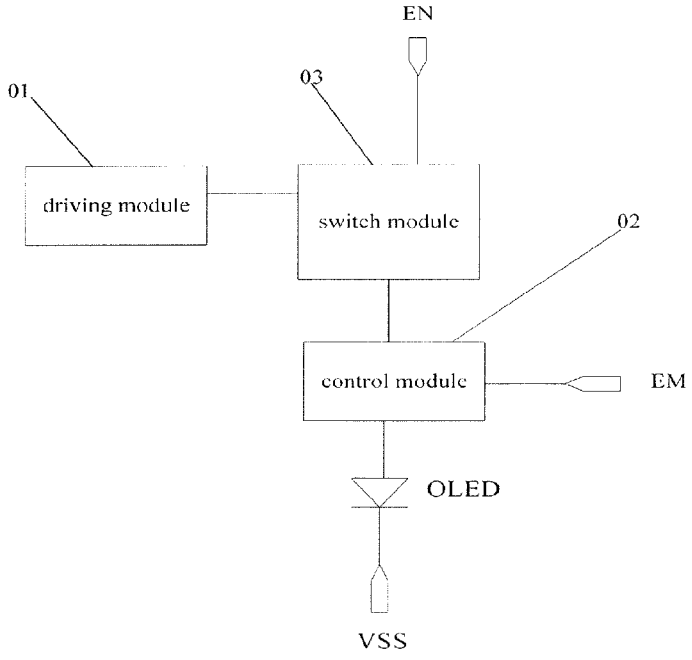
FIG. 2-FIG. 6 are exemplary views illustrating structures of pixel circuits according to embodiments of the present disclosure respectively.

As shown in FIG. 2, an embodiment of the present disclosure provides a pixel circuit, which may comprise: a light emitting device OLED, a driving module 01 configured to drive the light emitting device OLED to emit light and a control module 02 configured to control the light emitting device OLED to emit light during a light emitting stage; the pixel circuit further comprises a switch module 03;

a control terminal of the switch module 03 is connected with a switch signal terminal EN, an input terminal of the switch module 03 is connected with an output terminal of the driving module 01, and an output terminal of the switch module 03 is connected with an input terminal of the control module 02;

a control terminal of the control module 02 is connected with a light emitting signal terminal EM, and an output terminal of the control module 02 is connected with an input terminal of the light emitting device OLED; and an output terminal of the light emitting device OLED is connected with a low level signal terminal VSS;

under the control of the switch signal terminal EN, the switch module 03 is configured to be in an off state during a first frame of display picture as startup so as to prevent an abnormal drive current output by the driving module 01 from flowing to the control module 02, and is configured to be in an on state from a second frame of display picture so as to output a normal drive current output by the driving module 01 to the control module 02; under the control of the light emitting signal terminal EM, the control module 02 outputs the normal drive current output by the driving module 01 to the input terminal of the light emitting device OLED during the light emitting stage, and the light emitting device OLED emits light normally as driven by the normal drive current.

In the above-mentioned pixel circuit according to the embodiment of the present disclosure, under the control of the switch signal terminal, the switch module is in the off state during the first frame of display picture as startup so as to prevent an abnormal drive current output by the driving module from flowing to the control module, and is in the on state from the second frame of display picture so as to output the normal drive current output by the driving module to the control module; under the control of the light emitting signal terminal, the control module outputs the normal drive current output by the driving module to the input terminal of the light emitting device during the light emitting stage, and the light emitting device emits light normally when driven by the normal drive current.

In this way, by adding one switch module in the pixel circuit, the abnormal drive current output by the driving module is prevented from flowing to the light emitting device during the first frame of display picture as startup, and thus the problem of screen flicker can be overcome in the screen of the first frame when the display panel is started up; and additionally since the switch module can prevent the abnormal drive current of the pixel circuit from flowing to the light emitting device, a high level signal can be prevented from flowing to the low level signal terminal before a low level signal is input to the low level signal terminal; in this way, a positive potential will not occur before the low level signal terminal of the pixel circuit receives a low level signal, and thus the problem of the abnormal displaying of the display panel due to the self-protection function of a power supply signal chip triggered by the difficulty for the low level signal terminal of the pixel circuit receiving a positive potential and a negative potential can be overcome.

Figure 3:
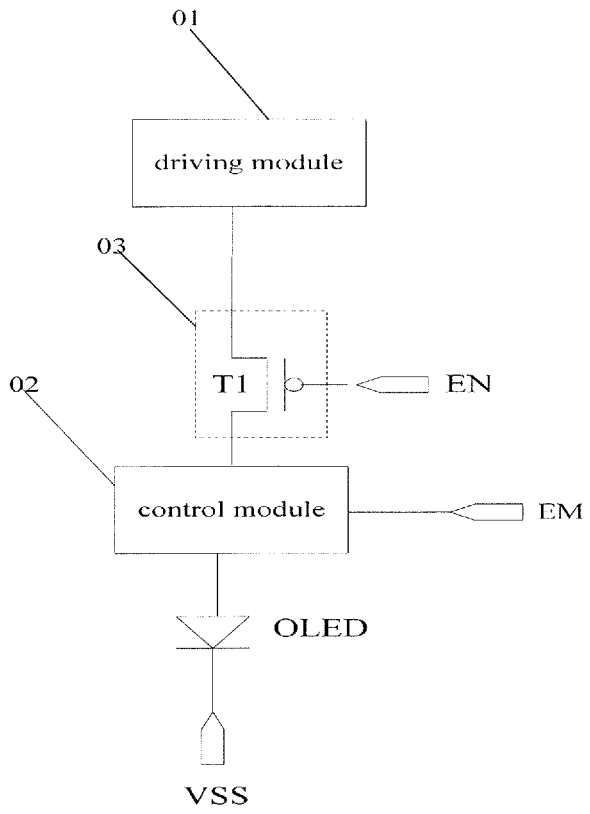

As implemented in practice, in the above-mentioned pixel circuit according to the embodiment of the present disclosure, as shown in FIG. 3, the switch module 03 may comprises: a first switch transistor T1; a gate of the first switch transistor T1 is connected with the switch signal terminal EN, the source of the first switch transistor T1 is connected with the output terminal of the driving module 01, and the drain of the first switch transistor T1 is connected with the input terminal of the control module 02.

Particularly, in the above-mentioned pixel circuit according to the embodiment of the present disclosure, from the second frame of display picture, the switch signal terminal may input a signal for turning on the first switch transistor T1, that is, when a low level signal is input by the switch signal terminal EN, the first switch transistor T1 is turned on, and the first switch transistor T1 which is in a turned-on state connects the output terminal of the driving module 01 to the input terminal of the control module 02, and then the drive current output by the driving module 01 passes through the control module 02 and is output to the input terminal of the light emitting device OLED for driving the light emitting device OLED to emit light normally.

Figure 4:
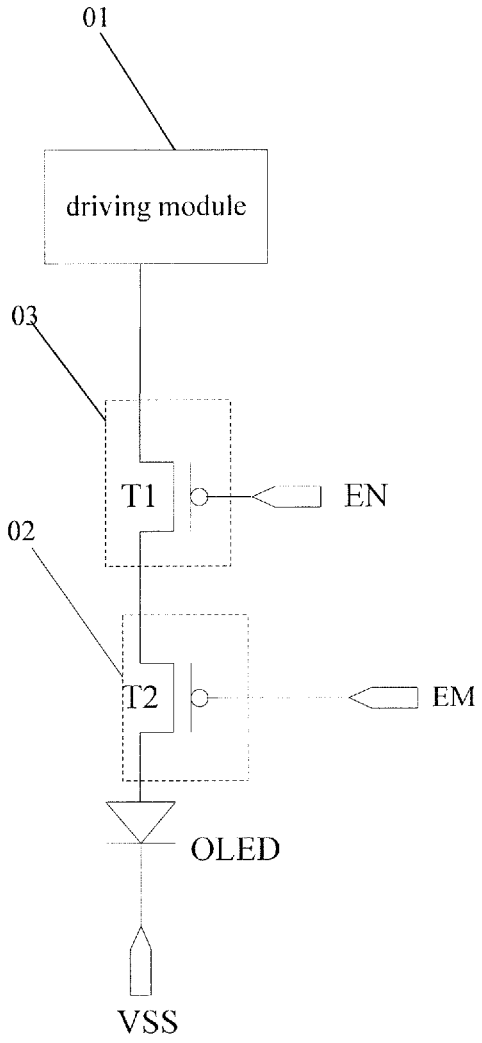

As implemented in practice, in the above-mentioned pixel circuit according to the embodiment of the present disclosure, as shown in FIG. 4, the control module 02 may comprises: a second switch transistor T2; a gate of the second switch transistor T2 is connected with the light emitting signal terminal EM, a source of the second switch transistor T2 is connected with an output terminal of the switch module 03, and a drain of the second switch transistor T2 is connected with the input terminal of the light emitting device OLED.

Particularly, in the above-mentioned pixel circuit according to the embodiment of the present disclosure, during the light emitting stage, the light emitting signal terminal EM may input a signal for turning on the second switch transistor T2; that is, when a low level signal is input by the light emitting signal terminal, the second switch transistor T2 will be in a turned-on state, and the second switch transistor T2 which is in the turned-on state connects the output terminal of the switch module 03 and the input terminal of the light emitting device OLED, and then the drive current for driving the light emitting device OLED to emit light may be output to the input terminal of the light emitting device OLED to drive the light emitting device OLED to emit light normally.

Figure 5:
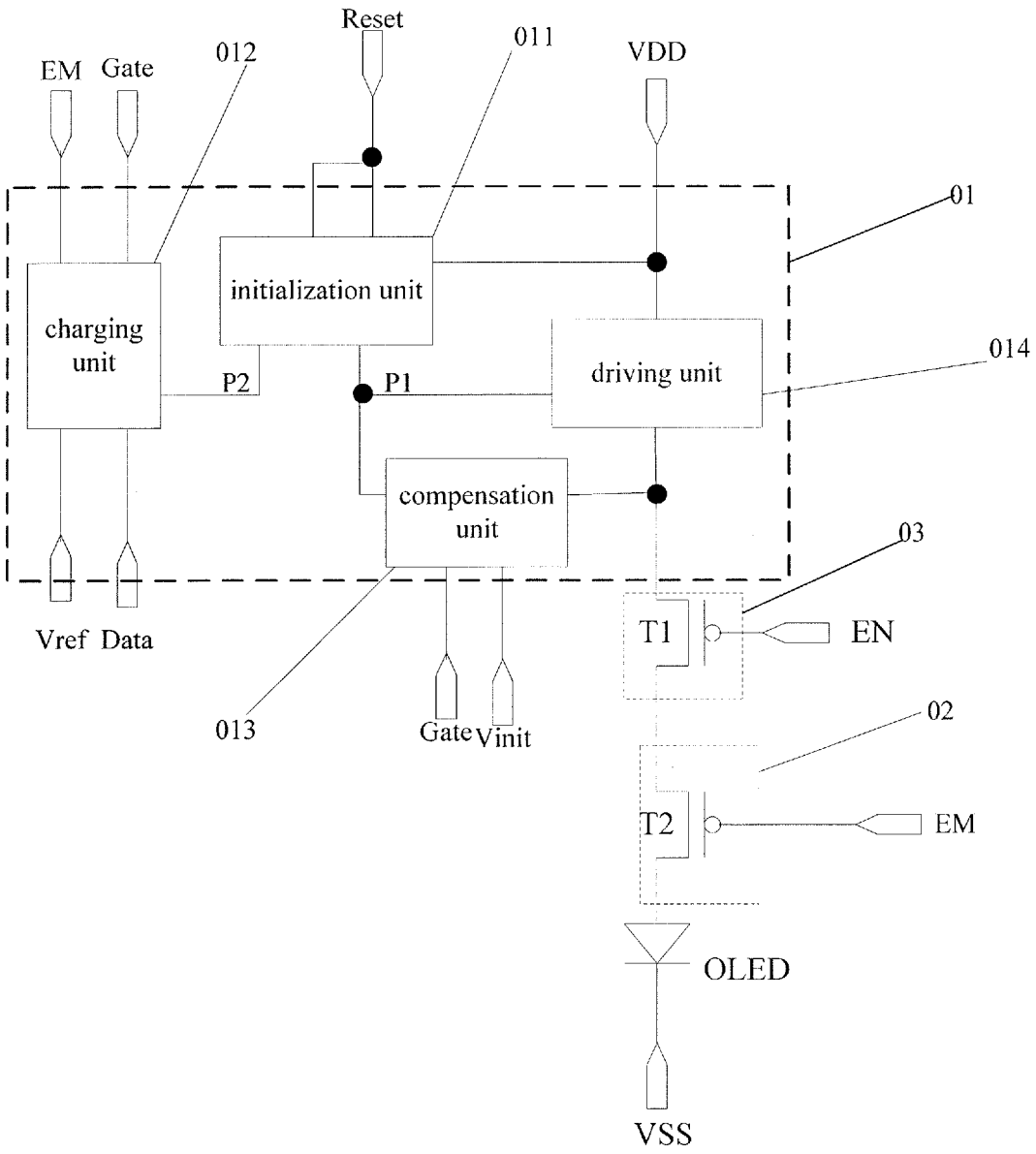

As implemented in practice, in the above-mentioned pixel circuit according to the embodiment of the present disclosure, as shown in FIG. 5, the driving module 01 may comprises: an initialization unit 011, a charging unit 012, a compensation unit 013 and a driving unit 014;

a control terminal of the driving unit 014 is connected with a first node P1, an input terminal of the driving unit 014 is connected with a high level signal terminal VDD, and an output terminal of the driving unit 014 is connected with the input terminal of the switch module 03 and an input terminal of the compensation unit 013 respectively; a control terminal of the compensation unit 013 is connected with a scanning signal terminal Gate, the output terminal of the compensation unit 013 is connected with the first node P1; a first control terminal of the charging unit 012 is connected with the scanning signal terminal Gate, a second control terminal of the charging unit 012 is connected with of the light emitting signal terminal EM, a first input terminal of the charging unit 012 is connected with a data signal terminal Data, a second input terminal of the charging unit 012 is connected with a reference signal terminal Vref, and an output terminal of the charging unit 012 is connected with a second node P2; the initialization unit 011 is connected with a reset signal terminal Reset, a restore signal terminal Vinit, a high level signal terminal VDD and the first node P1.

During an initialization stage, under the control of the reset signal terminal Reset, the initialization unit 011 is configured to perform initializations on the first node P1 and the second node P2 by a signal input via the restore signal terminal Vinit and a signal input via the high level signal terminal VDD respectively; during a charging stage, under the control of the scanning signal terminal Gate, the compensation unit 013 is configured to perform a compensation for a threshold voltage of the driving unit 014 at the first node P1, and under the control of the scanning signal terminal Gate, the charging unit 012 is configured to perform a data writing to the first node P1 by a signal input via the data signal terminal Data; during the light emitting stage, under the control of the light emitting signal terminal EM, the charging unit 012 is configured to perform an adjustment on a voltage signal at the first node P1 by a signal input via the reference signal terminal Vref, and under the control of the first node P1 at which the voltage signal is adjusted, the driving unit 014 outputs to the input terminal of the switch module 03 a drive current for driving the light emitting device OLED to emit light.

Particularly, in the above-mentioned pixel circuit according to the embodiment of the present disclosure, the driving module may comprise the initialization unit, the charging unit, the compensation unit and the driving unit, in this way, the driving module may perform the initialization on the first node and the second node by the initialization unit during the initialization stage, therefore an effect of a voltage difference in the previous stage on the subsequent stages; during the charging stage, the compensation for the threshold voltage and writing of the data are implemented by the compensation unit and the charging unit, the compensation for the threshold voltage can avoid an effect of varying in the threshold voltage on a luminance of the light emitting device, and an uniformity of the luminance of the light emitting device is improved and a quality of a display screen can be guaranteed; and during the light emitting stage, by adjusting the voltage signal at the first node by the charging unit, the drive current output by the drive transistor can be adjusted and then the luminance of the light emitting device can be adjusted, and thus the light emitting device may be driven to emit light normally.

Figure 6:
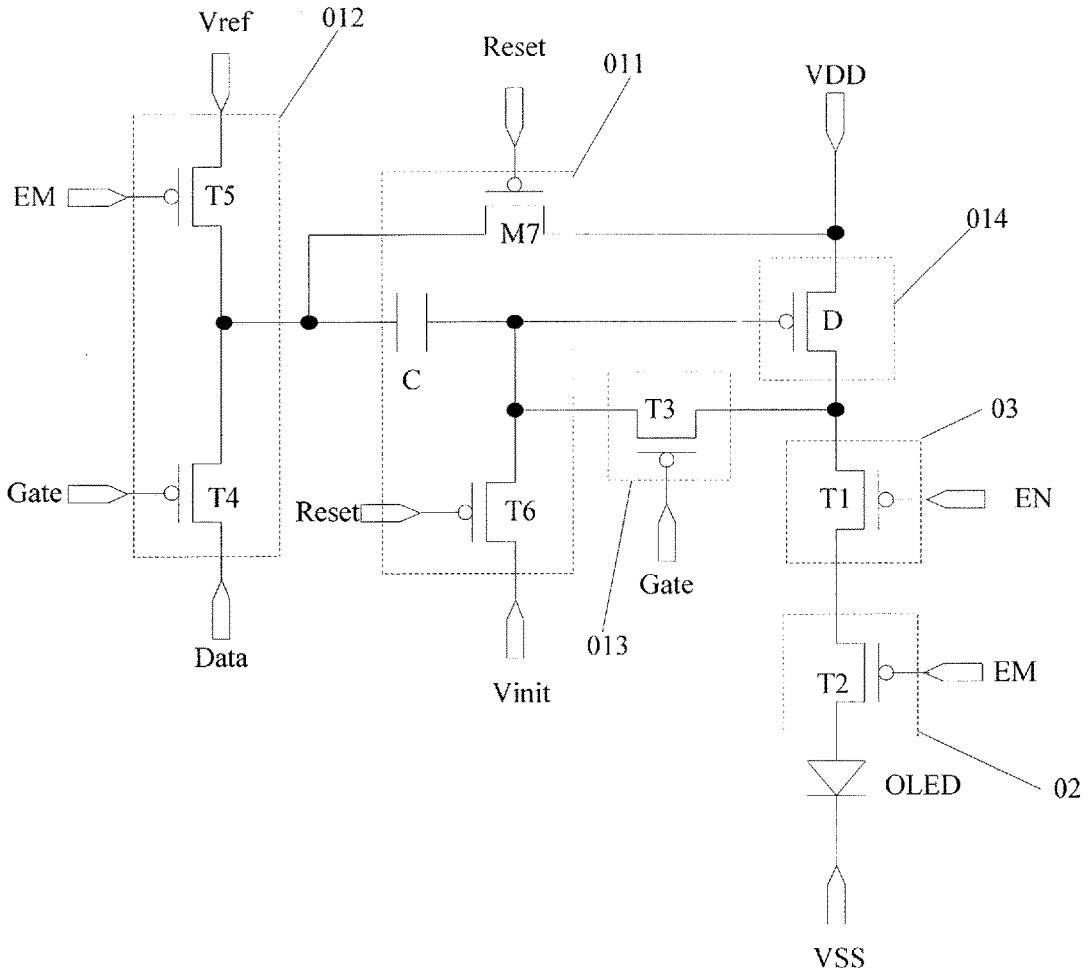

As implemented in practice, in the above-mentioned pixel circuit according to the embodiment of the present disclosure, as shown in FIG. 6, the driving unit 014 may comprises: a drive transistor D; a gate of the drive transistor D is connected with the first node P1, a source of the drive transistor D is connected with the high level signal terminal VDD, and a drain of the drive transistor D is connected with the input terminal of the switch module 03.

Particularly, in the above-mentioned pixel circuit according to the embodiment of the present disclosure, during the initialization stage, the initialization unit performs an initialization on the gate voltage of the drive transistor, i.e., the voltage of the first node; during the charging stage, the compensation unit performs the compensation for the threshold voltage of the drive transistor, and the charging unit performs the data writing to the first node; during the light emitting stage, the charging unit may perform an adjustment on the voltage at the first node, and then under the control of the first node at which the voltage is adjusted, the drive transistor may output the drive current for driving the light emitting device OLED to emit light during the light emitting stage.

As implemented in practice, in the above-mentioned pixel circuit according to the embodiment of the present disclosure, as shown in FIG. 6, the compensation unit 013 may comprises: a third switch transistor T3; a gate of the third switch transistor T3 is connected with the scanning signal terminal Gate, a source of the third switch transistor T3 is connected with the output terminal of the driving unit 014, and a drain of the third switch transistor T3 is connected with the first node P1.

Particularly, in the above-mentioned pixel circuit according to the embodiment of the present disclosure, during the charging stage, under the control of the scanning signal terminal Gate, the third switch transistor T3 is turned on, and then the third switch transistor T3 which is in the turned-on state connects the output terminal of the driving unit 014 and the first node P1, and at this point, the power supply signal Vdd input via the high level signal terminal VDD performs the compensation for the threshold voltage at the first node P1 via the drive transistor D and the third switch transistor T1 which is in the turned-on state until the voltage at the first node P1 reaches Vdd−Vth, and then the drive transistor D is turned off, and at this time the compensation for the threshold voltage of the drive transistor D may be completed.

As implemented in practice, in the above-mentioned pixel circuit according to the embodiment of the present disclosure, as shown in FIG. 6, the charging unit 012 may comprises: a fourth switch transistor T4 and a fifth switch transistor T5; wherein, a gate of the fourth switch transistor T4 is connected with the scanning signal terminal Gate, a source of the fourth switch transistor T4 is connected with the data signal terminal Data, and a drain of the fourth switch transistor T4 is connected with the second node P2; a gate of the fifth switch transistor 15 is connected with the light emitting signal terminal EM, a source of the fifth switch transistor T5 is connected with the reference signal terminal Vref, and a drain of the fifth switch transistor T5 is connected with the second node P2.

Particularly, in the above-mentioned pixel circuit according to the embodiment of the present disclosure, during the charging stage, under the control of the scanning signal terminal, the fourth switch transistor T4 is turned on, and then the fourth switch transistor T4 which is in the turned-on state may connect the data signal terminal Data and the second node P2, and thus a signal of the data signal terminal Data may be input to the second node P2; during the light emitting stage, under the control of the emit light signal terminal EM, the fifth switch transistor T5 is turned on, and then the fifth switch transistor T5 which is in the turned-on state connects the reference signal terminal Vref and the second node P2, and in turn a signal input via the reference signal terminal Vref may be output to the second node P2; since the first node P1 and the second node P2 correspond to the two terminals of the capacitor, the voltage signal at the first node P1 may be adjusted by the voltage signal input to the second node P2 by means of the charging and discharging function of the capacitor.

As implemented in practice, in the above-mentioned pixel circuit according to the embodiment of the present disclosure, as shown in FIG. 6, the initialization unit 011 may comprises: a sixth switch transistor T6, a seventh switch transistor T7 and a capacitor C; wherein, a gate of the sixth switch transistor T6 is connected with the reset signal terminal Reset, a source of the sixth switch transistor T6 is connected with the restore signal terminal Vinit, and a drain of the sixth switch transistor T6 is connected with the first node P1; a gate of the seventh switch transistor T7 is connected with the reset signal terminal Reset, a source of the seventh switch transistor T7 is connected with the high level signal terminal VDD, and a drain of the seventh switch transistor T7 is connected with the second node P2; and the capacitor C is connected between the first node P1 and the second node P2.

Particularly, in the above-mentioned pixel circuit according to the embodiment of the present disclosure, during the initialization stage, under the control of the reset signal terminal Reset, the sixth switch transistor T6 and the seventh switch transistor T7 are turned on, the sixth switch transistor T6 which is in the turned-on state connects the restore signal terminal Vinit and the first node P1, and thus the initialization is performed for the first node P1 by the signal input via the restore signal terminal Vinit; and the seventh switch transistor T7 which is in the turned-on state connects the high level signal terminal VDD and the second node P2, and then the initialization is performed for the second node P2 by the signal input via the high level signal terminal VDD.

It should be noted that, the switch transistors and the drive transistors mentioned in the above-described embodiments of the present disclosure may be Thin Film Transistors (TFTs), and may also be the Metal Oxide Semiconductor field effect tubes (MOSS), and there is no limitation on it. In a specific implementation, the sources and the drains of these transistors can be exchanged without being distinguished from each other. Various specific embodiments are explained by taking a thin film transistor as an example.

Figure 7:
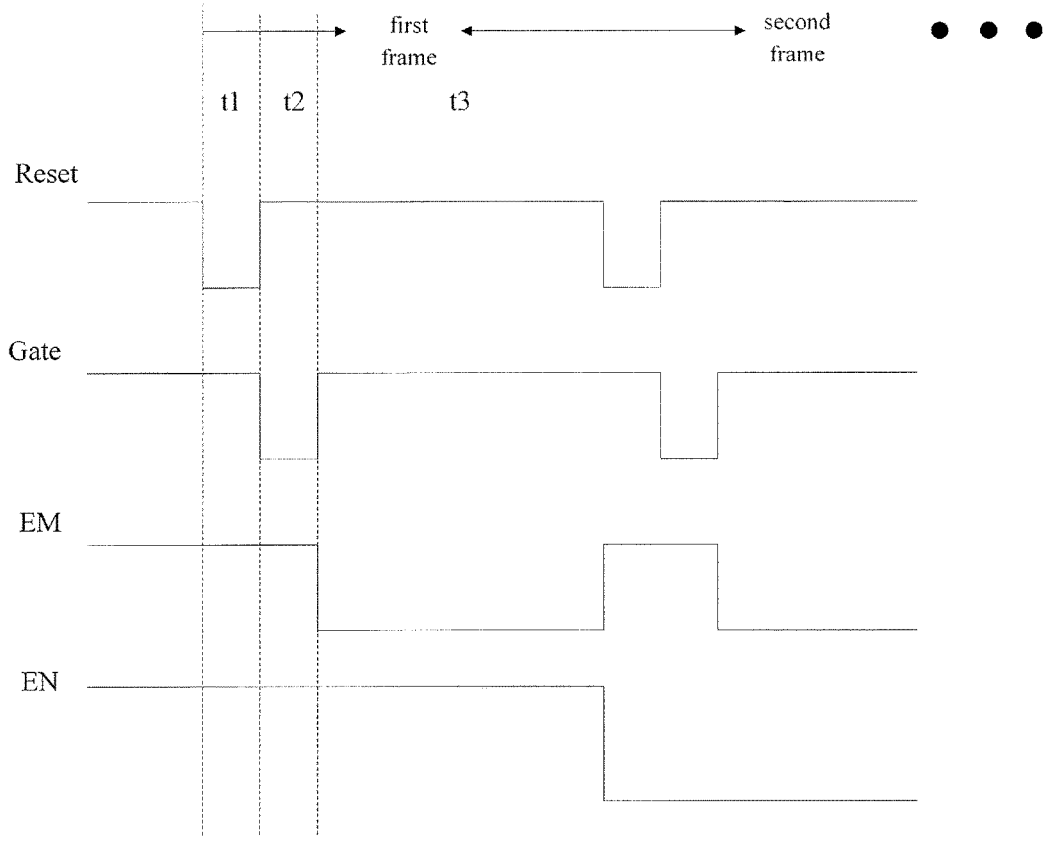
FIG. 7 is an operating timing schematic diagram of the pixel circuit according to an embodiment of the present disclosure.

Thereafter, an operating process of the pixel circuit according to embodiments of the present disclosure will be described in detail with reference to the pixel circuit and the operating timing according to embodiments of the present disclosure. The operating process of the pixel circuit according to embodiments of the present disclosure will be described by taking the pixel circuit as shown in FIG. 6 and the timing diagram of data inputting/outputting of the pixel circuit of FIG. 6 as shown in FIG. 7 as an example. Particularly, the description is given by selecting t1~t3 in the timing diagram of inputting/outputting as three stages. In the following description, from the time when the startup is performed to display a first frame, "1" indicates a high level signal, and "0" indicates a low level signal.

During the t1 stage, Reset=0, Gate=1, EM=1, and EN=1. Since Reset=0, the sixth switch transistor T6 and the seventh switch transistor T7 are turned on; since Gate=1, EM=1, and EN=1, the first switch transistor T1, the second switch transistor T2, the third switch transistor T3, the fourth switch transistor T4 and the fifth switch transistor T5 are turned off. The sixth switch transistor T6 which is in the turned-on state connects the restore signal terminal Vinit and the first node P1, and then the initialization is performed for the first node P1 by the signal input via the restore signal terminal Vinit; the seventh switch transistor T7 which is in the turned-on state connects the high level signal terminal VDD and the second node P2, and then the initialization is performed for the second node P2 by the signal input via the high level signal terminal VDD. The t1 stage is the initialization stage.

During the t2 stage, Reset=1, Gate=0, EM=1, and EN=1. Since Gate=0, the third switch transistor T3 and the fourth switch transistor T4 are turned on; since EM=1, Reset=1, and EN=1, the first switch transistor T1, the second switch transistor T2, the fifth switch transistor T5, the sixth switch transistor T6 and the seventh switch transistor T7 are turned off. The third switch transistor T3 which is in the turned-on state connects the drain of the drive transistor D and the first node P1, and due to a voltage difference occurs between the two terminals of the capacitor C during the initialization stage, the drive transistor D is in the turned-on state, and at this point the first node P1 is charged by the power supply signal Vdd input from the high level signal terminal VDD via the third switch transistor T3 and the drive transistor which are in the turned-on state, until the voltage at the first node reaches Vdd−Vth, then the drive transistor D is turned off, and at this time the compensation for the threshold voltage of the drive transistor D may be completed. The fourth switch transistor T4 which is in the turned-on state connects the data signal terminal Data and the second node P2, and thus a signal Vdata input by the data signal terminal Data is input to the second node P, and at this time the voltage difference between the two terminals of the capacitor C is Vdata−Vdd+vth. The t2 stage is the charging stage.

During the t3 stage, Reset=1, Gate1, and EM=0. Since EM=0, the second switch transistor T2 and the fifth switch transistor T5 are turned on; since Gate=1, Reset=1, and EN=1, the third switch transistor T3, the fourth switch transistor T4, the sixth switch transistor T6 and the seventh switch transistor T7 are turned off. The fifth switch transistor T5 which is in the turned-on state outputs the signal Vref input via the reference signal terminal to the second node P2, and the voltage signal at the first node P1 is adjusted by the capacitor C, and at this time, the voltage signal at the first node P1 is Vref−Vdata+Vdd−Vth, and under control of the voltage signal at the first node P1, the drive transistor D outputs a current $I=\frac{1}{2}*K(Vref-Vdata)^2$ for driving the light emitting device to emit light. At this time, the second switch transistor T2 which is in the turned-on state connects the drain of the first switch transistor T1 and the input terminal of the light emitting device OLED; however, since the first switch transistor T1 is in the turned-off state, the light emitting device OLED does not emit light. This is because during the first frame of display picture, the drive current output by the drive transistor D is an abnormally large current, and the first switch transistor T1 is in the turned-off state, then the abnormal drive current is prevented from flowing to the light emitting device OLED, and thus the problem of screen flicker can be overcome in the screen of the first frame when the display panel is started up. That is, after the startup, the first frame of display picture after startup is a black screen; however, from the second frame of display picture, a low level signal is input by the switch signal terminal EN, i.e., EN=0, and then the first switch transistor T1 is in the turned-on state, the first switch transistor T1 which is in the turned-on state connects the drain of the drive transistor D and the source of the second switch transistor T2, and thus the drive current output by the drive transistor D may be output to the input terminal of the light emitting device OLED, and therefore the light emitting device OLED is driven to emit light normally. The t3 stage is the light emitting stage.

In the subsequent time periods, the respective control signals are the same as those in the time period t3, therefore the light-emitting state of the light emitting device OLED will be maintained until a low level is input by the reset signal terminal Reset again in some time period.

Figure 8:
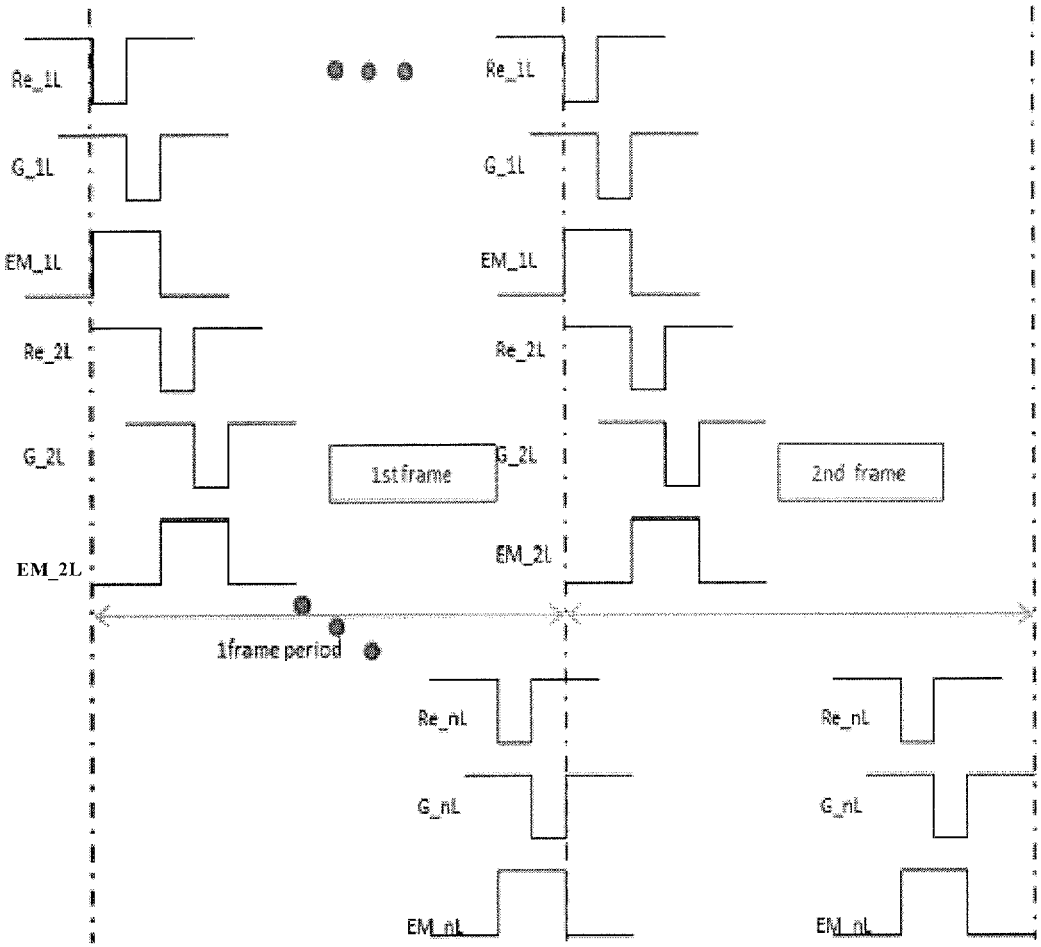
FIG. 8 is an operating timing schematic diagram of various control signals in the pixel circuit as being scanned line by line according to an embodiment of the present disclosure.

As implemented in practice, in a line by line scan process of the whole display panel, the input timing diagram of various control signals in the pixel circuit is shown in FIG. 8, wherein Re_1L, Re_2L, G_1L, G_2L, EM_1L, EM_2L . . . are the input timing for identifying various control signals in the first row, the second row . . . the nth row respectively. Particularly, it should be noted that, when the first frame is displayed, a high level signal is input by the switch signal terminal (not shown in FIG. 8), and from the second frame of display picture, a low level signal is input by the switch signal terminal (not shown in FIG. 8); in this way, the abnormal drive current output by the driving module during the first frame of display picture as startup can be prevented from flowing to the light emitting device, and thus the problem of screen flicker can be overcome in the screen of the first frame when the display panel is started up; and additionally since the switch module can prevent the abnormal drive current of the pixel circuit from flowing to the light emitting device, a high level signal can be prevented from flowing to the low level signal terminal before a low level signal is input to the low level signal terminal of the pixel circuit; in this way, a positive potential will not occur before the low level signal terminal of the pixel circuit receives a low level signal, and thus the problem of the abnormal displaying of the display panel due to the self-protection function of a power supply signal chip triggered by the difficulty for the low level signal terminal of the pixel circuit receiving a positive potential and a negative potential can be overcome.

An embodiment of the present disclosure provides an organic electroluminescent display panel, which comprises the above-mentioned pixel circuit according to the embodiment of the present disclosure. Since the principle for the organic electroluminescent display panel to solve problems is similar to that of the above-mentioned pixel circuit, therefore the implementation of the organic electroluminescent display panel can be founded in the implementation of the above-mentioned pixel circuit, and the repetitive parts will be omitted.

An embodiment of the present disclosure provides a display apparatus, which comprises the above-mentioned organic electroluminescent display panel according to the embodiment of the present disclosure. The display apparatus may be any products or components having the function of displaying such as a handset, a tablet computer, a TV set, a display, a notebook computer, a digital frame, and a navigator etc. Since the principle for the display apparatus to solve problems is similar to that of the above-mentioned organic electroluminescent display panel, therefore the implementation of the display apparatus can be found in the implementation of the above-mentioned organic electroluminescent display panel, and the repetitive parts will be omitted.

Embodiments of the present disclosure provide a pixel circuit, an organic electroluminescent display panel and a display apparatus, the pixel circuit comprises: a light emitting device, a driving module configured to drive the light emitting device to emit light, and a control module configured to control the light emitting device to emit light during a light emitting stage; and the pixel circuit further comprises: a switch module; under the control of the switch signal terminal, the switch module is configured to be in an off state during a first frame of display picture as startup so as to prevent an abnormal drive current output by the driving module from flowing to the control module, and is configured to be in an on state from a second frame of display picture so as to output a normal drive current output by the driving module to the control module; under the control of the light emitting signal terminal, the control module outputs the normal drive current output by the driving module to the input terminal of the light emitting device during the light emitting stage, and the light emitting device emits light normally when driven by the normal drive current. In this way, by adding one switch module in the pixel circuit, the abnormal drive current output by the driving module is prevented from flowing to the light emitting device during the first frame of display picture as startup, and thus the problem of screen flicker can be overcome in the screen of the first frame when the display panel is started up; and additionally since the switch module can prevent the abnormal drive current of the pixel circuit from flowing to the light emitting device, a high level signal is prevented from flowing to the low level signal terminal before a low level signal is input to the low level signal terminal; in this way, a positive potential will not occur before the low level signal terminal of the pixel circuit receives a low level signal, and thus the problem of the abnormal displaying of the display panel due to the self-protection function of a power supply signal chip triggered by the difficulty for the low level signal terminal of the pixel circuit receiving a positive potential and a negative potential can be overcome.

Obviously, those skilled in the art may make various changes and variations on the present disclosure without departing from the spirit and scope of the present disclosure. Thus, the present disclosure intends to cover the changes and variations to the present disclosure if such changes and variations belong to the scope defined by the claims of the present disclosure and equivalence thereof.

What is claimed is:

1. A pixel circuit, comprising: a light emitting device, a driving module configured to drive the light emitting device to emit light, and a control module configured to control the light emitting device to emit light during a light emitting stage; further comprising: a switch module;

a control terminal of the switch module is connected with a switch signal terminal, an input terminal of the switch module is connected with an output terminal of the driving module, and an output terminal of the switch module is connected with an input terminal of the control module;

a control terminal of the control module is connected with a light emitting signal terminal, and an output terminal of the control module is connected with an input terminal of the light emitting device; and an output terminal of the light emitting device is connected with a low level signal terminal;

under the control of the switch signal terminal, the switch module is configured to be in an off state during a first frame of display picture as startup and prevent an abnormal drive current output by the driving module from flowing to the control module, and is configured to be in an on state from a second frame of display picture so as to output a normal drive current output by the driving module to the control module, wherein each of the first frame of display picture and the second frame of display picture includes an initialization stage, a charging stage and the light emitting stage, during the initialization stage and the charging stage, the voltage level of the light emitting signal terminal is ineffective, and during the light emitting stage, the voltage level of the light emitting signal terminal is effective, and the switch module is configured to be in an off state during entire duration of the first frame;

under the control of the light emitting signal terminal, the control module outputs the normal drive current output by the driving module to the input terminal of the light emitting device during the light emitting stage, and the light emitting device emits light normally when driven by the normal drive current.

2. The pixel circuit as claimed in claim 1, wherein the switch module comprises: a first switch transistor;

a gate of the first switch transistor is connected with the switch signal terminal, a source of the first switch transistor is connected with the output terminal of the driving module, and a drain of the first switch transistor is connected with the input terminal of the control module.

3. The pixel circuit as claimed in claim 1, wherein the control module comprises: a second switch transistor;

a gate of the second switch transistor is connected with the light emitting signal terminal, a source of the second switch transistor is connected with an output terminal of the switch module, and a drain of the second switch transistor is connected with the input terminal of the light emitting device.

4. The pixel circuit as claimed in claim 1, wherein the driving module comprises: an initialization unit, a charging unit, a compensation unit and a driving unit;

a control terminal of the driving unit is connected with a first node, an input terminal of the driving unit is connected with a high level signal terminal, and an output terminal of the driving unit is connected with an input terminal of the switch module and an input terminal of the compensation unit respectively; a control terminal of the compensation unit is connected with a scanning signal terminal, an output terminal of the compensation unit is connected with the first node; a first control terminal of the charging unit is connected with the scanning signal terminal, a second control terminal of the charging unit is connected with of the light emitting signal terminal, a first input terminal of the charging unit is connected with a data signal terminal, a second input terminal of the charging unit is connected with a reference signal terminal, and an output terminal of the charging unit is connected with a second node; the initialization unit is connected with a reset signal terminal, a restore signal terminal, the high level signal terminal and the first node;

during the initialization stage, under the control of the reset signal terminal, the initialization unit is configured to perform an initialization for the first node and the second node by a signal input via the restore signal terminal and a signal input via the high level signal terminal respectively; during the charging stage, under the control of the scanning signal terminal, the compensation unit is configured to perform an compensation for the threshold voltage of the driving unit at the first node, and under the control of the scanning signal terminal, the charging unit is configured to perform a data writing to the first node by a signal input via the data signal terminal; during the light emitting stage, under the control of the light emitting signal terminal, the charging unit is configured to perform an adjustment on a voltage signal at the first node by a signal input via the reference signal terminal, and under the control of the first node at which the voltage signal is adjusted, the driving unit outputs to the input terminal of the switch module a drive current for driving the light emitting device to the emit light.

5. The pixel circuit as claimed in claim 4, wherein the driving unit comprises: a drive transistor;

a gate of the drive transistor is connected with the first node, a source of the drive transistor is connected with the high level signal terminal, and a drain of the drive transistor is connected with an input terminal of the switch module.

6. The pixel circuit as claimed in claim 4, wherein the compensation unit comprises: a third switch transistor;

a gate of the third switch transistor is connected with the scanning signal terminal, a source of the third switch transistor is connected with the output terminal of the driving unit, and a drain of the third switch transistor is connected with the first node.

7. The pixel circuit as claimed in claim 4, wherein the charging unit comprises: a fourth switch transistor and a fifth switch transistor; wherein, a gate of the fourth switch transistor is connected with the scanning signal terminal, a source of the fourth switch transistor is connected with the data signal terminal, and a drain of the fourth switch transistor is connected with the second node;

a gate of the fifth switch transistor is connected with the light emitting signal terminal, the source of the fifth switch transistor is connected with the reference signal terminal, and the drain of the fifth switch transistor is connected with the second node.

8. The pixel circuit as claimed in claim 4, wherein the initialization unit comprises: a sixth switch transistor, a seventh switch transistor and a capacitor; wherein, a gate of the sixth switch transistor is connected with the reset signal terminal, a source of the sixth switch transistor is connected with the restore signal terminal, and a drain of the sixth switch transistor is connected with the first node;

a gate of the seventh switch transistor is connected with the reset signal terminal, a source of the seventh switch transistor is connected with the high level signal terminal, and a drain of the seventh switch transistor is connected with the second node;

the capacitor is connected between the first node and the second node.

9. An organic electroluminescent display panel, comprising a pixel circuit, the pixel circuit comprises: a light emitting device, a driving module configured to drive the light emitting device to emit light, and a control module configured to control the light emitting device to emit light during a light emitting stage; further comprising: a switch module;

a control terminal of the switch module is connected with a switch signal terminal, an input terminal of the switch module is connected with an output terminal of the driving module, and an output terminal of the switch module is connected with an input terminal of the control module;

a control terminal of the control module is connected with a light emitting signal terminal, and an output terminal of the control module is connected with an input terminal of the light emitting device; and an output terminal of the light emitting device is connected with a low level signal terminal;

under the control of the switch signal terminal, the switch module is configured to be in an off state during a first frame of display picture as startup and prevent an abnormal drive current output by the driving module from flowing to the control module, and is configured to be in an on state from a second frame of display picture so as to output a normal drive current output by the driving module to the control module, wherein each of the first frame of display picture and the second frame of display picture includes an initialization stage, a charging stage and the light emitting stage, during the initialization stage and the charging stage, the voltage level of the light emitting signal terminal is ineffective, and during the light emitting stage, the voltage level of the light emitting signal terminal is effective, and the switch module is configured to be in an off state during entire duration of the first frame;

under the control of the light emitting signal terminal, the control module outputs the normal drive current output by the driving module to the input terminal of the light emitting device during the light emitting stage, and the light emitting device emits light normally when driven by the normal drive current.

10. The organic electroluminescent display panel as claimed in claim 9, wherein the switch module comprises: a first switch transistor;

a gate of the first switch transistor is connected with the switch signal terminal, a source of the first switch transistor is connected with the output terminal of the driving module, and a drain of the first switch transistor is connected with the input terminal of the control module.

11. The organic electroluminescent display panel as claimed in claim 9, wherein the control module comprises: a second switch transistor;

a gate of the second switch transistor is connected with the light emitting signal terminal, a source of the second switch transistor is connected with an output terminal of the switch module, and a drain of the second switch transistor is connected with the input terminal of the light emitting device.

12. The organic electroluminescent display panel as claimed in claim 9, wherein the driving module comprises: an initialization unit, a charging unit, a compensation unit and a driving unit;

a control terminal of the driving unit is connected with a first node, an input terminal of the driving unit is connected with a high level signal terminal, and an output terminal of the driving unit is connected with an input terminal of the switch module and an input terminal of the compensation unit respectively; a control terminal of the compensation unit is connected with a scanning signal terminal, an output terminal of the compensation unit is connected with the first node; a first control terminal of the charging unit is connected with the scanning signal terminal, a second control terminal of the charging unit is connected with of the light emitting signal terminal, a first input terminal of the charging unit is connected with a data signal terminal, a second input terminal of the charging unit is connected with a reference signal terminal, and an output terminal of the charging unit is connected with a second node; the initialization unit is connected with a reset signal terminal, a restore signal terminal, the high level signal terminal and the first node;

during the initialization stage, under the control of the reset signal terminal, the initialization unit is configured to perform an initialization for the first node and the second node by a signal input via the restore signal terminal and a signal input via the high level signal terminal respectively; during the charging stage, under the control of the scanning signal terminal, the compensation unit is configured to perform an compensation for the threshold voltage of the driving unit at the first node, and under the control of the scanning signal terminal, the charging unit is configured to perform a data writing to the first node by a signal input via the data signal terminal; during the light emitting stage, under the control of the light emitting signal terminal, the charging unit is configured to perform an adjustment on a voltage signal at the first node by a signal input via the reference signal terminal, and under the control of the first node at which the voltage signal is adjusted, the driving unit outputs to the input terminal of the switch module a drive current for driving the light emitting device to the emit light.

13. The organic electroluminescent display panel as claimed in claim 12, wherein the driving unit comprises: a drive transistor;

a gate of the drive transistor is connected with the first node, a source of the drive transistor is connected with the high level signal terminal, and a drain of the drive transistor is connected with an input terminal of the switch module.

14. The organic electroluminescent display panel as claimed in claim 12, wherein the compensation unit comprises: a third switch transistor;

a gate of the third switch transistor is connected with the scanning signal terminal, a source of the third switch transistor is connected with the output terminal of the driving unit, and a drain of the third switch transistor is connected with the first node.

15. The organic electroluminescent display panel as claimed in claim 12, wherein the charging unit comprises: a fourth switch transistor and a fifth switch transistor; wherein, a gate of the fourth switch transistor is connected with the scanning signal terminal, a source of the fourth switch transistor is connected with the data signal terminal, and a drain of the fourth switch transistor is connected with the second node;

a gate of the fifth switch transistor is connected with the light emitting signal terminal, the source of the fifth switch transistor is connected with the reference signal terminal, and the drain of the fifth switch transistor is connected with the second node.

16. The organic electroluminescent display panel as claimed in claim 12, wherein the initialization unit comprises: a sixth switch transistor, a seventh switch transistor and a capacitor; wherein, a gate of the sixth switch transistor is connected with the reset signal terminal, a source of the sixth switch transistor is connected with the restore signal terminal, and a drain of the sixth switch transistor is connected with the first node;

a gate of the seventh switch transistor is connected with the reset signal terminal, a source of the seventh switch transistor is connected with the high level signal terminal, and a drain of the seventh switch transistor is connected with the second node;

the capacitor is connected between the first node and the second node.

17. A display apparatus, comprising an organic electroluminescent display panel having a pixel circuit, the pixel circuit comprises: a light emitting device, a driving module configured to drive the light emitting device to emit light, and a control module configured to control the light emitting device to emit light during a light emitting stage; further comprising: a switch module;

a control terminal of the switch module is connected with a switch signal terminal, an input terminal of the switch module is connected with an output terminal of the driving module, and an output terminal of the switch module is connected with an input terminal of the control module;

a control terminal of the control module is connected with a light emitting signal terminal, and an output terminal of the control module is connected with an input terminal of the light emitting device; and an output terminal of the light emitting device is connected with a low level signal terminal;

under the control of the switch signal terminal, the switch module is configured to be in an off state during a first frame of display picture as startup and prevent an abnormal drive current output by the driving module from flowing to the control module, and is configured to be in an on state from a second frame of display picture so as to output a normal drive current output by the driving module to the control module, wherein each of the first frame of display picture and the second frame of display picture includes an initialization stage, a charging stage and the light emitting stage, during the initialization stage and the charging stage, the voltage level of the light emitting signal terminal is ineffective, and during the light emitting stage, the voltage level of the light emitting signal terminal is effective, and the switch module is configured to be in an off state during the entire duration of the first frame;

under the control of the light emitting signal terminal, the control module outputs the normal drive current output by the driving module to the input terminal of the light emitting device during the light emitting stage, and the light emitting device emits light normally when driven by the normal drive current.

18. The display apparatus as claimed in claim 17, wherein the switch module comprises: a first switch transistor;

a gate of the first switch transistor is connected with the switch signal terminal, a source of the first switch transistor is connected with the output terminal of the driving module, and a drain of the first switch transistor is connected with the input terminal of the control module.

19. The display apparatus as claimed in claim 17, wherein the control module comprises: a second switch transistor;

a gate of the second switch transistor is connected with the light emitting signal terminal, a source of the second switch transistor is connected with an output terminal of the switch module, and a drain of the second switch transistor is connected with the input terminal of the light emitting device.

20. The display apparatus as claimed in claim 17, wherein the driving module comprises: an initialization unit, a charging unit, a compensation unit and a driving unit;

a control terminal of the driving unit is connected with a first node, an input terminal of the driving unit is connected with a high level signal terminal, and an output terminal of the driving unit is connected with an input terminal of the switch module and an input terminal of the compensation unit respectively; a control terminal of the compensation unit is connected with a scanning signal terminal, an output terminal of the compensation unit is connected with the first node; a first control terminal of the charging unit is connected with the scanning signal terminal, a second control terminal of the charging unit is connected with of the light emitting signal terminal, a first input terminal of the charging unit is connected with a data signal terminal, a second input terminal of the charging unit is connected with a reference signal terminal, and an output terminal of the charging unit is connected with a second node; the initialization unit is connected with a reset signal terminal, a restore signal terminal, the high level signal terminal and the first node;

during the initialization stage, under the control of the reset signal terminal, the initialization unit is configured to perform an initialization for the first node and the second node by a signal input via the restore signal terminal and a signal input via the high level signal terminal respectively; during the charging stage, under the control of the scanning signal terminal, the compensation unit is configured to perform an compensation for the threshold voltage of the driving unit at the first node, and under the control of the scanning signal terminal, the charging unit is configured to perform a data writing to the first node by a signal input via the data signal terminal; during the light emitting stage, under the control of the light emitting signal terminal, the charging unit is configured to perform an adjustment on a voltage signal at the first node by a signal input via the reference signal terminal, and under the control of the first node at which the voltage signal is adjusted, the driving unit outputs to the input terminal of the switch module a drive current for driving the light emitting device to the emit light.

* * * * *